US008710809B2

(12) United States Patent
Khare et al.

(10) Patent No.: US 8,710,809 B2
(45) Date of Patent: Apr. 29, 2014

(54) VOLTAGE REGULATOR STRUCTURE THAT IS OPERATIONALLY STABLE FOR BOTH LOW AND HIGH CAPACITIVE LOADS

(75) Inventors: Rupesh Khare, Berkshire (GB); Nitin Bansal, Gurgaon (IN)

(73) Assignee: STMicroelectronics International N.V., Amsterdam (NL)

( * ) Notice: Subject to any disclaimer, the term of this patent is extended or adjusted under 35 U.S.C. 154(b) by 221 days.

(21) Appl. No.: 13/170,679

(22) Filed: Jun. 28, 2011

(65) Prior Publication Data

US 2013/0002213 A1 Jan. 3, 2013

(51) Int. Cl.
*G05F 1/00* (2006.01)

(52) U.S. Cl.
USPC ..... 323/266; 323/270

(58) Field of Classification Search
USPC ..... 323/266, 269, 270
See application file for complete search history.

(56) References Cited

U.S. PATENT DOCUMENTS

| | | | | |
|---|---|---|---|---|
| 6,249,110 | B1 * | 6/2001 | Geyer et al. | 323/272 |
| 6,424,128 | B1 * | 7/2002 | Hiraki et al. | 323/268 |
| 6,700,360 | B2 * | 3/2004 | Biagi et al. | 323/280 |
| 6,703,815 | B2 * | 3/2004 | Biagi | 323/280 |
| 8,063,619 | B2 * | 11/2011 | Zhu et al. | 323/282 |
| 8,237,425 | B1 * | 8/2012 | Smith et al. | 323/314 |
| 2003/0218454 | A1 * | 11/2003 | Cunnac et al. | 323/316 |
| 2007/0241730 | A1 * | 10/2007 | Dow et al. | 323/280 |
| 2010/0019747 | A1 * | 1/2010 | Kao et al. | 323/274 |
| 2010/0079121 | A1 * | 4/2010 | Yanagawa | 323/277 |

* cited by examiner

*Primary Examiner* — Adolf Berhane
*Assistant Examiner* — Emily P Pham
(74) *Attorney, Agent, or Firm* — Gardere Wynne Sewell LLP

(57) ABSTRACT

A regulator structure includes a first differential amplifier having a first input coupled to a reference voltage node. A second differential amplifier has a first input coupled to the output of the first differential amplifier. A third differential amplifier has a first input coupled to the output of the first differential amplifier. A first pmos transistor has its gate coupled to the second differential amplifier output, and its drain coupled to a second input of each of the first and second differential amplifiers. A second pmos transistor has its gate coupled to the third differential amplifier output, and its drain configured to output a regulated voltage which is also a second input of the third differential amplifier. A circuit is configured to replicate the regulated voltage and couple the replicated regulated voltage to the drain of the first pmos transistor.

23 Claims, 3 Drawing Sheets

VOLTAGE REGULATOR STRUCTURE THAT IS OPERATIONALLY STABLE FOR BOTH LOW AND HIGH CAPACITIVE LOADS

TECHNICAL FIELD

The present invention relates broadly to a voltage regulator structure, to devices comprising the voltage regulator structure, and to a method of providing a regulated output voltage.

BACKGROUND

Voltage regulators find use in many applications, such as in the integrated circuits used in the automotive industry. For example, with reference to FIG. 1, a power supply system 100, used in an automotive integrated circuit, may comprise first and second regulators 102, 104, of which the first regulator 102 is coupled to a main domain 106, whereas the second regulator 104 is coupled to a back-up domain 108. Here, the first regulator 102 may be a high capacity regulator with a higher current consumption compared to the lower capacity second regulator 104. There are typically three operational modes of the system 100 as follows. In a run mode, the switch 110 is on, and both the first and the second regulators 102, 104 see an external capacitance 112, and both the main domain 106 and the back-up domain 108 are powered. In a standby mode, the first regulator 102 is switched off, with the switch 110 remaining on. As such, the second regulator 104 continues to see the external capacitance 112, i.e. the external capacitance remains charged. This enables changing of the operational mode from the standby to the run mode without significant charge-up delay.

In a back-up mode, again the first regulator 102 is switched off while the second regulator 104 remains on, but the switch 110 is in an off position. In this mode, the second regulator 104 no longer sees the external capacitance 112, and, with the first regulator 102 being switched off, the external load 112 will discharge. As a result, moving from the back-up mode to the run mode will have a charge-up delay.

In many applications, of which the system in FIG. 1 is only one example, there is a need to provide a regulator architecture that is stable for low as well as high capacitive loads.

FIG. 2 shows an open loop architecture 200 of a regulator with an nmos driver 202, which can provide a solution that is stable for both low and high capacitive loads. However, the architecture 200 can only function for a large drop out due to the $V_{gs}$ required for the nmos driver 202. For example, for an output voltage $V_{out}$ of 1.2 volt, $V_{gs}$ may be of the order of 1.0V, thus requiring a supply voltage $V_{in}$ of for example about 2.5V. Furthermore, because there is no feedback coming directly from $V_{out}$, $V_{out}$ is not very well controlled, and use of a nmos driver also means that load regulation is poor.

A need therefore exists to provide a regulator structure that seeks to address one or more of the abovementioned problems.

SUMMARY

Embodiments of the present invention provide a regulator architecture providing a low drop out solution, stability over a large range of capacitive loads, and good current load regulation.

According to a first embodiment of the present invention, there is provided a regulator structure comprising a first differential amplifier configured to provide an output as one of the inputs into each of a second and third differential amplifiers; the third differential amplifier configured to provide an output to the gate of a first pmos transistor and to receive a drain voltage of the first pmos transistor as the other input; the first pmos transistor configured to have an external load applied at a drain at a regulated voltage; the second differential amplifier configured to provide an output to the gate of a second pmos transistor and to receive a drain voltage of the second pmos transistor as the other input; wherein the first differential amplifier is further configured to receive the drain voltage of the second pmos transistor and a reference voltage as inputs; and wherein the drain of the second pmos transistor is coupled to the gate of the first pmos transistor to replicate the regulated voltage at the drain of the first pmos transistor.

The first differential amplifier may have a higher gain than the second and third differential amplifiers.

The second and third differential amplifiers may have substantially the same specifications.

The drain of the second pmos transistor may be coupled to the gate of the first pmos transistor via a third pmos transistor.

The third pmos transistor may have a gate coupled to the gate of the first pmos transistor.

The drain of the third pmos transistor may be coupled to the drain of the second transistor.

The drain of the second pmos transistor may be coupled to the gate of the first pmos transistor via the third pmos transistor and a current mirror circuit.

The second and third pmos transistors may have substantially the same specifications.

A same supply voltage may be applied to the first, second, and third differential amplifiers.

The same supply voltage may be applied to the sources of the first and the second pmos transistors.

According to a second embodiment of the present invention, there is provided a device comprising a regulator structure as defined in the first aspect.

The device may comprise an automotive integrated circuit, a GPS transceiver, or a set-top box.

According to a third embodiment of the present invention, there is provided a method of providing a regulated voltage output, the method comprising the steps of providing a first differential amplifier configured to provide an output as one of the inputs into each of a second and third differential amplifiers, the third differential amplifier configured to provide an output to the gate of a first pmos transistor and to receive a drain voltage of the first pmos transistor as the other input; the first pmos transistor configured to have an external load applied at a drain at the regulated voltage, and the second differential amplifier configured to provide an output to the gate of a second pmos transistor and to receive a drain voltage of the second pmos transistor as the other input; providing the drain voltage of the second pmos transistor and a reference voltage as inputs to the first differential amplifier; and coupling the drain of the second pmos transistor to the gate of the first pmos transistor to replicate the regulated voltage at the drain of the first pmos transistor.

BRIEF DESCRIPTION OF THE DRAWINGS

Embodiments of the invention will be better understood and readily apparent to one of ordinary skill in the art from the following written description, by way of example only, and in conjunction with the drawings, in which.

DETAILED DESCRIPTION

Figure 1:
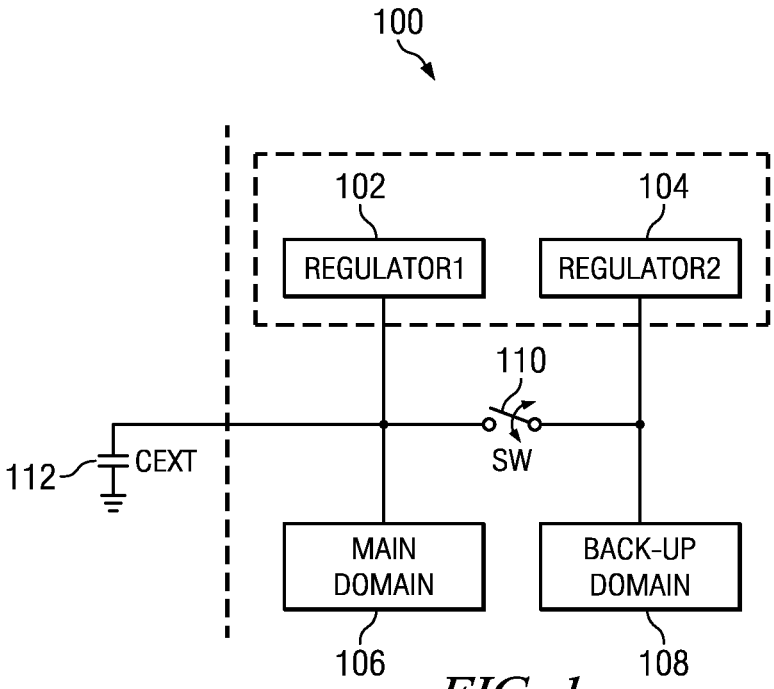
FIG. 1 (PRIOR ART)
FIG. 1 is a schematic drawings illustrating an automotive power supply system.
Figure 2:
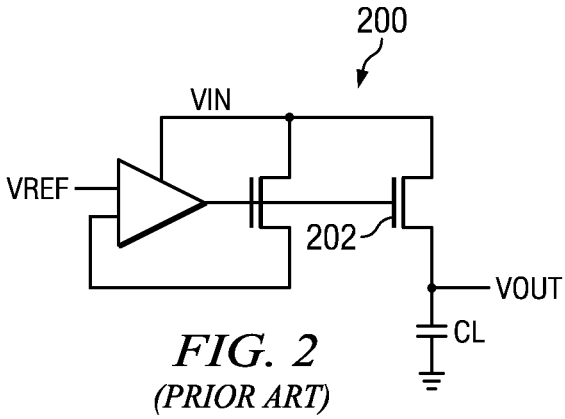
FIG. 2 (PRIOR ART)
FIG. 2 shows an open loop architecture of a regulator with an nmos driver.
Figure 3:
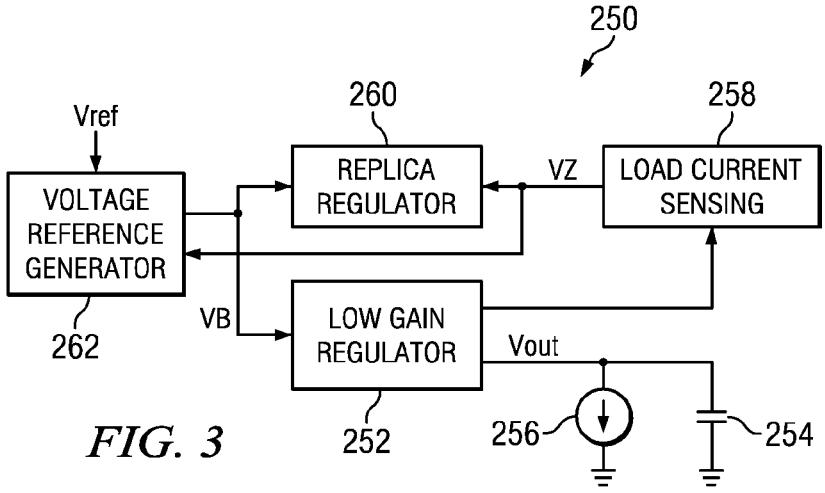
FIG. 3 shows a basic block diagram of a regulator structure according to an example embodiment.

FIG. 3 shows a basic block diagram of a regulator structure 250. The regulator structure 250 includes a low gain regulator 252 which is stable across different capacitive 254 and/or current 256 loads. A load current sensing circuit 258 is coupled to the low gain regulator 252 and is operable to sense the load current provided at the regulator output. A replica regulator circuit 260 receives an output of the load current sensing circuit 258 (for example, a signal indicative of the sensed load current) as a feedback signal applied to the regulated output node of the replica regulator circuit. A variable voltage reference generator 262 also receives an output of the load current sensing circuit 258 (for example, a signal indicative of the sensed load current) as a feedback signal. The variable voltage reference generator 262 also receives a reference voltage Vref and outputs a second reference voltage VB that is applied as a reference voltage to each of the replica regulator circuit 260 and the low gain regulator 252.

The low gain regulator 252 is essential to ensure stability across different capacitive loads 254. However, a low gain regulator 252 is not able to provide good load regulation (load regulation is change in output voltage with change in load current 256, wherein ideally the output voltage Vout should not change with changing load current). With increasing load as Vout falls, the regulator structure 250 functions to increase the second reference voltage VB that is applied as a reference voltage to each of the replica regulator circuit 260 and the low gain regulator 252. The benefit of this is that the change in VB produces a reduction in the fall of the regulated output Vout. This serves to improve load regulation.

Thus, the variable voltage reference generator 262 must be operable to generate a variable reference VB. To accomplish this, the load current sensing circuit 258 senses the load current of the low gain regulator 252. This sensed load current is converted to signal applied at the regulated output VZ as a feed back to the replica regulator circuit 260. The replica regulator circuit 260 is essentially a copy or replica of the low gain regulator 252 except that it has a ratioed current capability (in order to keep current consumption under check). The application of the sensed load current output signal to the replica regulator circuit 260 causes the regulated output VZ to fall.

The voltage VZ is sensed by the variable voltage reference generator 262 which functions to differentially compare the voltage VZ to the reference voltage Vref. The variable voltage reference generator 262 then responds to the detected difference between the voltage VZ to the reference voltage Vref by adjusting the second reference voltage VB that is applied as a reference voltage to each of the replica regulator circuit 260 and the low gain regulator 252.

Figure 4:
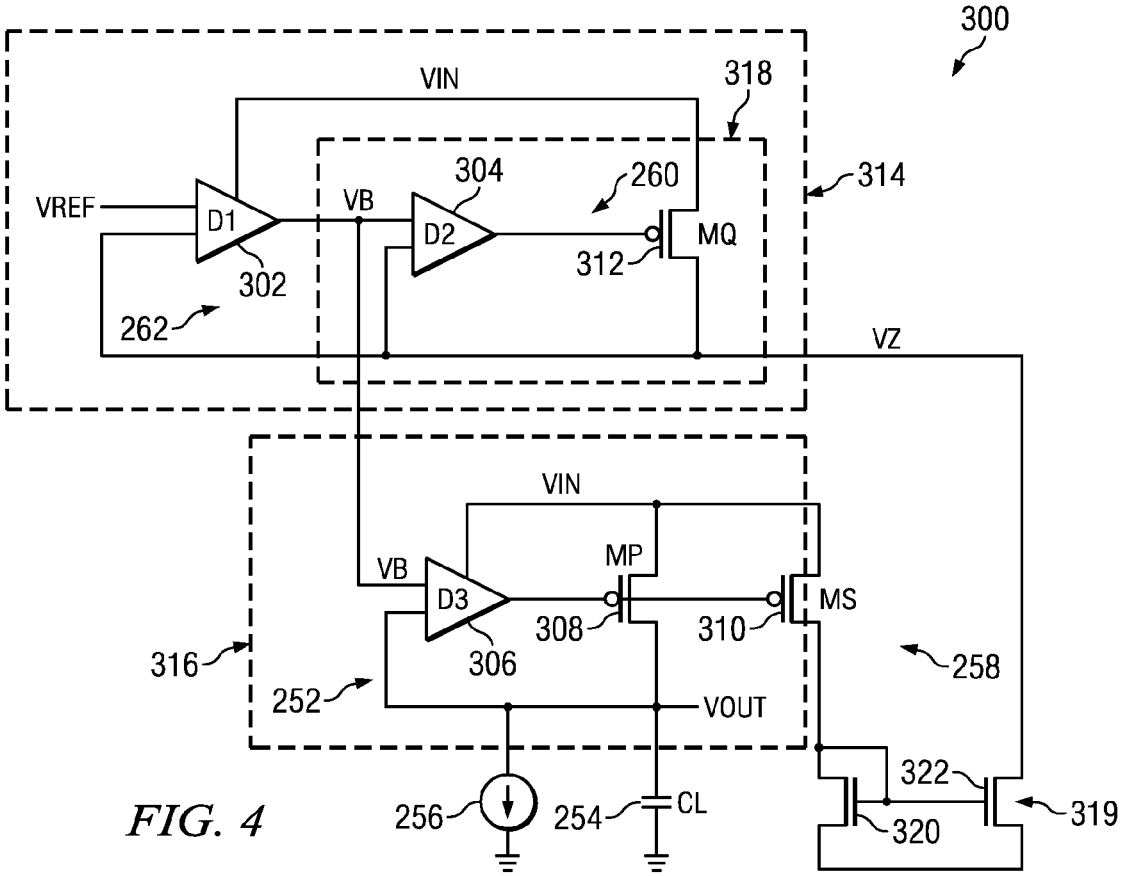
FIG. 4 shows a circuit diagram of the regulator structure of FIG. 3.

FIG. 4 shows a regulator structure 300 according to an example embodiment (for implementing the regulator structure 250 of FIG. 3). The regulator structure 300 includes a first high gain differential amplifier 302 (D1), that drives the input VB for a low-gain differential amplifier 304 (D2).

A third differential amplifier 306 (D3) also has VB as an input and drives the gate of a driver pmos 308. The drain of the driver pmos 308 is the output $V_{out}$ of the regulator structure 300, and is fed back to the input of differential amplifier 306.

In one example implementation, the high gain amplifier 302 has a gain of about 45-50 dB, whereas the differential gain amplifiers 304 and 306 have a relatively lower gain of about 20-30 dB, such that the differential amplifiers 304, 306 can be readily stabilized, as will be appreciated by a person skilled in the art. The amplifiers 304 and 306 preferably have the same or similar specifications.

A sense pmos transistor 310 senses the load current through the driver pmos transistor 308 and feeds back a scaled current to the pmos transistor 312. Because of this feedback current, VB rises with rising load current improving the load regulation, as will be described in more detail below.

The driver pmos transistor 308 in an example implementation is a large pmos device to provide the output current, whereas the pmos transistor 312 is a small pmos device. The pmos transistor 310 is a scaled version of pmos transistor 308. The scale range can for example be around 1000 or less and pmos transistors 312 and 310 may, but are not limited to, having the same size used to sense the current flowing through pmos transistor 308. The sizes of the transistors in various embodiments depend on the value of load current to be supplied, input supply, etc., as will be appreciated by a person skilled in the art.

In the example embodiment, the current through the driver pmos transistor 308 is thus sensed through the sense pmos transistor 310, which is of scaled-down dimension from pmos transistor 308 as mentioned above. The sensed current is then fed as a load current to pmos transistor 312, through a current mirror circuit 319, formed by two nmos transistors 320, 322 in this example embodiment.

As differential amplifier 306 is a low gain amplifier in the example embodiment, and $V_{out}$ is fed back to the differential amplifier 306 to drive the gate of the driver pmos 308, $V_{out}$ is well regulated. However, for a fixed level of VB, only a limited load current regulation would be achieved by way of the differential amplifier 306 and the driver pmos 308. Therefore, in the example embodiment, a replica of $V_{out}$ is produced at the drain of the pmos 312 via the sensing pmos 310. The scaling is chosen such that $V_z$ is equal to $V_{out}$. Thus, the replica of $V_{out}$ is fed back to both, high gain differential amplifier 302 and low gain amplifier 304.

In the regulator structure 300, VB therefore changes when $V_{out}$ changes. In particular, if $V_{out}$ decreases, as a result of an increased load current drawn, VB will rise at the output of the high gain differential amplifier 302. In turn, the increased VB at the input of low gain differential amplifiers 306 and 304 achieves that, despite being a low gain differential amplifier, the current load regulation range is increased accordingly.

Regulator structure 300 may be viewed as consisting of a main loop 314 including the high gain differential amplifier 302, a secondary loop 316 including the low gain differential amplifier 306, and a replica loop 318 including the low gain differential amplifier 304, for "replicating" the secondary loop 316 and providing a replica of $V_{out}$ as feed back to the high gain differential amplifier 302.

Furthermore, the regulator structure 300 does not require a large dropout. Instead, assuming for example $V_{out}$ at 1.2 volt, $V_{in}$ needs only to be equal to or marginally larger than the sum of $V_{out}$ and $V_{ds}$ of the pmos, i.e. $V_{in}$ may be about 1.5 volt.

The example embodiment described can provide a regulator architecture being a low drop out solution but providing stable operation over a large range of capacitive loads, and good current load regulation. The example embodiment can find application in numerous devices in which low power consumption regulator circuits exhibiting stability over a large range of capacitive loads and with good current load regulation, such as, but not limited to, automotive integrated circuits, GPS transceivers, set-top box, etc.

Figure 5:
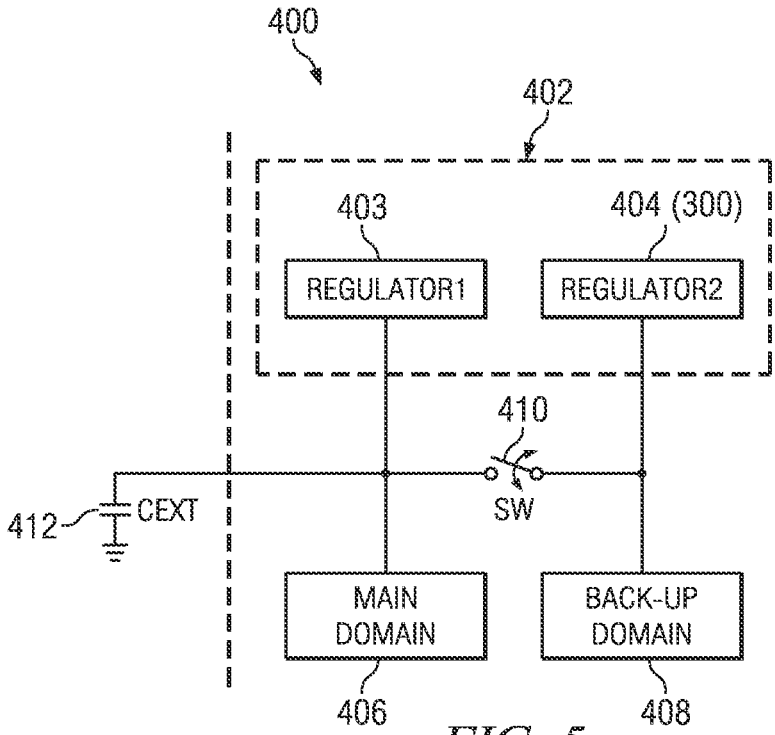
FIG. 5 shows a schematic drawing illustrating an automotive integrated circuit incorporating a power supply system according to an example embodiment.

FIG. 5 shows a schematic drawing illustrating a device, here in the form of an automotive integrated circuit 400 (or alternatively a GPS transceiver, or a set-top box, or the like) incorporating a power supply system 402. The power supply system 402 comprises first and second regulators 403, 404, of which the first regulator 403 is coupled to a main domain 406, whereas the second regulator 404 is coupled to a back-up domain 408. The first regulator 402 is a high capacity regulator with a higher current consumption compared to the lower capacity second regulator 404, which is implemented as a regulator 300 according to the example embodiment described above with reference to FIGS. 3 and 4. As a result, the regulator 404 is stable for low as well as high capacitive loads in the different operation modes of the power supply system 402, i.e. for switch 410 in "off" or "on" state respectively.

Figure 6:
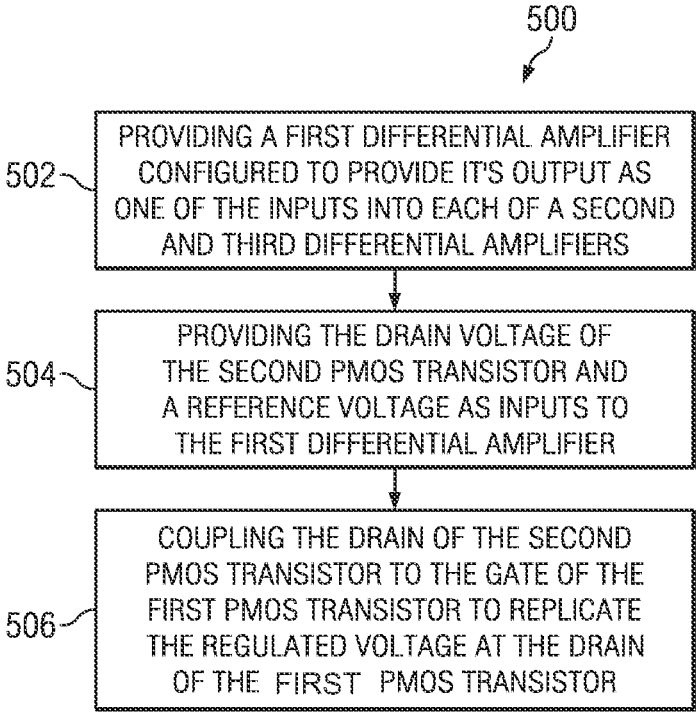
FIG. 6 is a flow diagram illustrating operation.

FIG. 6 is a flow diagram illustrating the operational steps of the regulator circuit.

The described embodiments of the present invention can provide a regulator architecture providing a low drop out solution, stability over a large range of capacitive loads, and good current load regulation.

While this detailed description has set forth some embodiments of the present invention, the appended claims cover other embodiments of the present invention which differ from the described embodiments according to various modifications and improvements. For example, while single transistor elements have been described with reference to the example implementation shown in FIG. 4, it will be appreciated that multiple transistor devices may be used in different example embodiments. Also, while a current mirror using two nmos transistors has been described with reference to the example implementation shown in FIG. 4, it will be appreciated that other mirror circuit designs may be used in different example embodiments.

Within the appended claims, unless the specific term "means for" or "step for" is used within a given claim, it is not intended that the claim be interpreted under 35 U.S.C. 112, paragraph 6.

What is claimed is:

1. A regulator structure, comprising:

a low gain voltage regulator circuit having an input coupled to receive a variable reference voltage and an output configured to provide a regulated output voltage;

a load current sensing circuit configured to sense load current supplied by the low gain voltage regulator circuit;

a replica voltage regulator circuit having an input coupled to receive said variable reference voltage and an output whose voltage is modified in response to the sensed load current by the load current sensing circuit; and a variable reference voltage generator having a first input coupled to receive a voltage reference, a second input coupled to receive the modified output voltage of the replica voltage regulator circuit and output configured to supply the variable reference voltage.

2. The regulator structure of claim 1, wherein the variable reference voltage generator further comprises a first differential amplifier having a first input coupled to a voltage reference node, a second input coupled to a modified output voltage node and having an output configured to supply the variable reference voltage.

3. The regulator structure of claim 2, wherein the replica voltage regulator circuit further comprises:

a second differential amplifier having a first input coupled to the output of the first differential amplifier; and a first pmos transistor having a gate coupled to an output of the second differential amplifier, the first pmos transistor having a drain coupled to a second input of the second differential amplifier and coupled to a second input of the first differential amplifier.

4. The regulator structure of claim 3, wherein the low gain voltage regulator circuit further comprises:

a third differential amplifier having a first input coupled to the output of the first differential amplifier; and a second pmos transistor having a gate coupled to an output of the third differential amplifier, the second pmos transistor having a drain configured to output the regulated output voltage and coupled to a second input of the third differential amplifier.

5. The regulator structure of claim 4, wherein the load current sensing circuit is coupled between the output of the third differential amplifier and the drain of the first pmos transistor.

6. The regulator structure of claim 5, wherein the load current sensing circuit further comprises:

a third pmos transistor having a gate coupled to the output of the third differential amplifier and a drain producing a first current which is a replica of the load current supplied by the low gain voltage regulator circuit.

7. The regulator structure of claim 6, wherein the output voltage of the replica voltage regulator circuit is modified in response to the first current.

8. The regulator structure of claim 7 wherein the load current sensing circuit further comprises a current mirror circuit configured to receive the first current and generate a second current, said second current applied to the drain of the first pmos transistor.

9. The regulator structure of claim 4, wherein the first differential amplifier has a higher gain than the second and third differential amplifiers.

10. The regulator structure of claim 4, wherein the second and third differential amplifiers have substantially the same specifications.

11. A regulator structure, comprising:

a first differential amplifier having a first input coupled to a reference voltage node and having an output;

a second differential amplifier having a first input coupled to the output of the first differential amplifier;

a third differential amplifier have a first input coupled to the output of the first differential amplifier;

a first pmos transistor having a gate coupled to an output of the second differential amplifier, the first pmos transistor having a drain coupled to a second input of the second differential amplifier and coupled to a second input of the first differential amplifier;

a second pmos transistor having a gate coupled to an output of the third differential amplifier, the second pmos transistor having a drain configured to output a regulated voltage for coupling to an external load and coupled to a second input of the third differential amplifier; and a circuit configured to replicate the regulated voltage, output a replicated regulated voltage and couple the replicated regulated voltage to the drain of the first pmos transistor.

12. The regulator structure of claim 11, wherein the first differential amplifier has a higher gain than the second and third differential amplifiers.

13. The regulator structure of claim 11, wherein the second and third differential amplifiers have substantially the same specifications.

14. The regulator structure of claim 11, wherein the circuit configured to replicate comprises a third pmos transistor configured to couple the gate of the second pmos transistor to the drain of the first pmos transistor.

15. The regulator structure of claim 14, wherein a gate of the third pmos transistor is coupled to the gate of the second pmos transistor.

16. The regulator structure of claim 14, wherein a drain of the third pmos transistor is coupled to the drain of the first pmos transistor.

17. The regulator structure of claim 14, further comprising a transistor circuit coupling a drain of the third pmos transistor to the drain of the first pmos transistor.

18. The regulator structure of claim 17, wherein the transistor circuit is a current mirror circuit.

19. A system, comprising:

a first regulator structure having an output configured to be coupled to a capacitive structure and supply power to a main circuit domain;

a second regulator structure having an output configured to be coupled to supply power to a back-up circuit domain;

a switching circuit selectively connecting the output of the first regulator structure to the output of the second regulator structure;

wherein said second regulator structure comprises:

a low gain voltage regulator circuit having an input coupled to receive a variable reference voltage and an output configured to provide a regulated output voltage;

a load current sensing circuit configured to sense load current supplied by the low gain voltage regulator circuit;

a replica voltage regulator circuit having an input coupled to receive said variable reference voltage and an output whose voltage is modified in response to the sensed load current by the load current sensing circuit; and a variable reference voltage generator having a first input coupled to receive a voltage reference, a second input coupled to receive the modified output voltage of the replica voltage regulator circuit and output configured to supply the variable reference voltage.

20. The system of claim 19, wherein the first and second regulator structures supply power for operating one of an automotive integrated circuit, a GPS transceiver, or a set-top box.

21. A regulator structure, comprising:

a low gain voltage regulator circuit including a first differential amplifier having a first input and a second input coupled to receive a variable reference voltage, a first transistor driven by an output of the first differential amplifier and an output node coupled to the transistor and second input and configured to provide a regulated output voltage;

a load current sensing circuit configured to sense load current supplied by the low gain voltage regulator circuit;

a replica voltage regulator circuit having an input coupled to receive said variable reference voltage and an output whose voltage is modified in response to the sensed load current by the load current sensing circuit; and a variable reference voltage generator configured to generate said variable reference voltage.

22. The regulator structure of claim 21, wherein said variable reference voltage generator comprises: a differential circuit having a first input coupled to receive a voltage reference, a second input coupled to the output of the load current sensing circuit and an output configured to supply the variable reference voltage.

23. The regulator structure of claim 21, wherein said replica voltage generator circuit further comprises: a second differential amplifier having a first input coupled to an output of the load current sensing circuit and a second input coupled to receive said variable reference voltage, a second transistor driven by an output of the second differential amplifier and coupled to the output of the load current sensing circuit.

* * * * *